US006308629B1

(12) United States Patent
Smith

(10) Patent No.: US 6,308,629 B1
(45) Date of Patent: Oct. 30, 2001

(54) MANIPULATION OF PRINTING BLANKETS

(75) Inventor: John M. Smith, High Wycombe (GB)

(73) Assignee: Duco International Limited, Winchester (GB)

( * ) Notice: Subject to any disclaimer, the term of this patent is extended or adjusted under 35 U.S.C. 154(b) by 0 days.

(21) Appl. No.: 08/952,064

(22) PCT Filed: May 9, 1996

(86) PCT No.: PCT/GB96/01114

§ 371 Date: Dec. 24, 1997

§ 102(e) Date: Dec. 24, 1997

(87) PCT Pub. No.: WO96/35582

PCT Pub. Date: Nov. 14, 1996

(30) Foreign Application Priority Data

May 10, 1995 (GB) ..... 9509479

(51) Int. Cl.[7] ..... B41L 47/14; B41F 27/00

(52) U.S. Cl. ..... 101/477; 101/382.1; 101/212; 101/216; 101/415.1

(58) Field of Search ..... 101/477, 479, 101/382.1, 375, 376, 378, 493, 212, 216, 219, 141, 142, 415.1, 401.1

(56) References Cited

U.S. PATENT DOCUMENTS 3,156,182 * 11/1964 Ritzerfeld et al. ..... 101/142
3,750,573 * 8/1973 Haeusler et al. ..... 101/415.1
4,377,974 * 3/1983 Kirkpatrick ..... 101/378
5,216,953 * 6/1993 Hada ..... 101/375
5,347,927 * 9/1994 Berna et al. ..... 101/401.1
5,355,795 * 10/1994 Moss et al. ..... 101/141
5,413,043 * 5/1995 Fuhrmann et al. ..... 101/415.1
5,435,242 * 7/1995 Kusch et al. ..... 101/415.1
5,657,692 * 8/1997 Theriault et al. ..... 101/477
5,738,015 * 4/1998 Kusch et al. ..... 101/477

* cited by examiner

*Primary Examiner*—Eugene Eickholt
(74) *Attorney, Agent, or Firm*—Nixon & Vanderhye P.C.

(57) ABSTRACT

A container for a printing blanket comprises a cassette of dimensions sufficient at least to contain a printing blanket in wound form. The cassette comprising a casing of generally cylindrical shape having a longitudinal opening for sheet-form egression of a printing blanket from within the cassette. In one preferred embodiment, the cassette has a pressure slide attached to or integral therewith adjacent to the longitudinal opening, for pressing a printing blanket on a press cylinder when the blanket is fed onto the cylinder. The cassette is employed in the manipulation of large adhesive-backed printing blankets for web-feed offset printing presses.

1 Claim, 2 Drawing Sheets

MANIPULATION OF PRINTING BLANKETS

BACKGROUND OF THE INVENTION

1. Field of the Invention

This invention relates to manipulation of printing blankets.

2. Discussion of Prior Art

A common means for securing an offset printing blanket onto a press cylinder employs a tensioning 'lock-up' device located within the cylinder body. Employment of such a device usually necessitates a gap in the usable printing area of the cylinder and furthermore tends to promote undesirable vibration during operation of the printing press, especially at high-speed printing.

It has been proposed to avoid vibration by providing a 'seamless' or endless blanket on the printing press cylinder. Typically such blankets are supplied on a metal sleeve to be fitted on the cylinder. Although such blankets may be feasible for newly manufactured presses wherein means for ease of removal of the cylinder or sleeve may be incorporated in the design of the press, they are not a practicable option for the majority of existing presses. Moreover, a disadvantage of such blankets is the high cost of producing individual blanketed sleeves or cylinders in comparison with the cost of producing a sheet-form (open-ended) blanket for application to replace a worn or damaged similar blanket on an existing cylinder in the press.

In some relatively small offset printing presses (such as those used for printing stationery and business forms), in which the printing cylinder typically has a circumference of the order of 30 cm, a negligible gap in the usable printing area is achieved by securing a sheet-form printing blanket on the cylinder by means of an adhesive which typically is in the form of an adhesive coating on the back of the blanket sheet and may be protected by a releasable cover sheet until the blanket is applied to the cylinder.

Although adhesive-backed printing blankets are used for small presses, generally they have not been used for large web-feed printing presses owing to problems in handling and mounting large sheets of adhesive-backed blanket. Problems include manual handling difficulties and safety risk to persons manipulating a bulky adhesive-backed blanket, the risk of contamination of the adhesive backing during manipulation, and the need for the initial positioning of the blanket on the cylinder to be accurate since the capability for position-adjustment after initial application usually is extremely limited or non-existent without detriment to the blanket or the adhesive bond.

In large high-speed printing presses, such as those used in the newspaper and magazine printing industry, typically the printing blanket requires to be replaced owing to wear at frequent intervals, for instance every one to three months. Speed of application of a replacement blanket onto the cylinder is especially important in the newspaper and magazine printing industry where a long down-time of a printing press could be highly detrimental to meeting distribution deadlines.

SUMMARY OF THE INVENTION

An object of the present invention is the provision of means to facilitate manipulation of large adhesive-backed printing blankets to enable their commercial application to large printing press cylinders.

A further object of the invention is the provision of means for enabling a printing blanket, especially an adhesive-backed printing blanket, to be applied to a press cylinder accurately with increased speed.

A further object of the invention is the provision of means for enabling adhesive-backed blankets to be stored, transported, handled and applied easily, accurately and quickly, with minimal risk of contamination of the adhesive, damage to the blanket and trapping of air between the blanket and the cylinder.

The invention is beneficial for blankets of all sizes, with or without an adhesive backing. However, the benefits are especially advantageous in respect of large adhesive-backed printing blankets for web-feed offset printing presses.

According to one aspect of the present invention there is provided manipulation means for a printing blanket, comprising a cassette of dimensions sufficient at least to contain a printing blanket in wound form, said cassette comprising a casing of generally cylindrical shape having a longitudinal opening for sheet-form egression of a printing blanket from within the cassette.

According to another aspect of the invention there is provided a method of mounting a printing blanket on a printing press cylinder, which comprises feeding the blanket onto the cylinder from a cassette described in the immediately preceding paragraph.

The cassette casing may have a substantially continuous cylindrical wall (apart from the opening for egression of the blanket), or it may have a discontinuous cylindrical shape, for instance a frame structure.

The cassette may be open or closed at one or both of the casing cylinder ends. At least one of the ends may be closed by a cap which is removable for insertion of a blanket into the cassette.

The blanket suitably is in roll-wound form inside the cassette. Preferably the outer, leading, end of the contained blanket is positioned adjacent to the longitudinal opening which suitably is an elongate gap or slot in the casing wall.

If desired, the cassette may include a spindle, which may or may not be rotatable, about which the blanket is wound. The longitudinal central axes of the cassette casing and spindle may be coincident or parallel. For instance, the spindle axis may be off-set away from the casing axis along a plane passing through the position at which the blanket begins to diverge from the blanket roll when the blanket is fed through the longitudinal opening.

Preferably the cassette casing should have sufficient rigidity to retain its shape during handling, feeding and loading of the blanket. Suitable materials include plastics and metals.

The cassette may be reusable or disposable.

For feeding a blanket from the cassette onto a press cylinder, the cassette should be mounted in a set relationship to the press cylinder. For instance, location means may comprise an axial spigot extending from each end of the cassette for location in a hole, slot or cup on the press structure, if desired in conjunction with detent means to prevent the spigots from becoming dislodged accidentally.

Suitably the cassette is mounted such that its longitudinal axis is parallel to that of the press cylinder onto which the blanket is to be fed.

The blanket may be fed from the cassette onto the press cylinder simply by pulling the leading end of the blanket through the longitudinal opening of the cassette, positioning the leading end of the blanket securely on the surface of the cylinder, and rotating the cylinder to pull the rest of the blanket from the cassette onto the cylinder surface.

The cassetted blanket may be of a length to fit the cylinder exactly or it may be longer than the circumference of the cylinder and then trimmed to the correct length, e g by cutting or stamping on the cylinder. Alternatively the cassette may contain two or more blanket pieces for application to the cylinder as one piece after another in line or as one piece on top of another.

When the blanket has an adhesive-coating protected by a releasable sheet, the protective sheet suitably is removed from the blanket continuously as the blanket is fed from the cassette. This may be done manually or by a separator blade and the released sheet may be collected in a bin or by winding on a roller.

Preferably the blanket is pressed onto the cylinder during its application in order to ensure good bonding contact and to prevent trapping of air between the blanket and the cylinder.

If desired, the blanket may be pressed onto the cylinder manually, such as by moving a roller under pressure over the blanket on the cylinder continuously from the line of initial contact.

However, a preferred pressure means comprises a dedicated pressure roller or a pressure slide (skid), mounted with its longitudinal axis parallel to those of the cassette and cylinder and at a set distance from the cylinder surface at or immediately after the line of initial contact of the blanket with the cylinder. The maximum distance of the pressure roller or slide surface from the cylinder surface should not be greater than the thickness of the blanket being applied and may be adjustably set to apply a predetermined pressure on the blanket.

The pressure slide may have a curved surface, at least at its edge portion proximate to the casing opening, to facilitate smooth sliding of the blanket over the slide surface. The pressure slide may be attached to the press structure or, preferably, may be attached to, or be integral with, the cassette casing.

The pressure means may be mounted to be guided towards and away from the cylinder as required.

If desired, the leading end portion of the blanket may be located on the pressure means, such as by use of a relatively weak adhesive (e g double sided adhesive tape), prior to mounting the pressure means at its pressure distance from the cylinder. The pressure means is then moved to its pressure distance with the leading end portion of the blanket between the pressure means and the cylinder. Such a procedure may be useful for reducing the risk of operator contact with the adhesive backing on the blanket since the protective sheet may be released from the leading end portion of the blanket more easily while the end portion is supported on the pressure means. The weak adhesive employed to locate the blanket end portion on the pressure means should be capable of releasing the blanket from the pressure means when the cylinder is subsequently rotated during feeding of the blanket onto the cylinder.

After application of the blanket onto the cylinder, usually the cassette and, if employed, the pressure means are moved away from the cylinder and may be removed altogether from the press frame.

The present invention is suitable for employment in conjunction with the invention described in our co-pending patent application filed on Dec. 29, 1997 entitled 'Printing Press Cylinders' U.S. Ser. No. 08/952,065. When used in conjunction with the invention described in said co-pending patent application, the leading edge of the blanket may be located along the nearer edge of the slit in the cylinder surface or overlapping the slit and then trimmed along the slit.

The adhesive employed for attaching a blanket to a press cylinder must be stable at the temperatures created during high speed running of the printing press and should be resistant to solvents employed for cleaning the blanket.

Preferably the adhesive should be such as to enable removal of a worn or damaged blanket by peeling off the cylinder with no or minimal adhesive residue left on the cylinder surface.

The adhesive layer should be of low thickness and of uniform consistency in order to avoid conferring even small aberrations on the total blanket thickness.

Accordingly, a contact adhesive usually is employed and typically such adhesives have a high initial bond strength which resists adjustment of the position of the blanket after contact with the cylinder. However, other types of adhesive, for instance a settable adhesive (e g heat- or radiation-settable) or a reaction adhesive (e g comprising a pressure-rupturable microencapsulated reactant), may be employed provided that they satisfy the requirements for a printing operation.

The adhesive typically is employed as a pre-coating on the cylinder-side (back) of the blanket and is protected by a releasable sheet of flexible material such as paper or plastics film until immediately prior to application of the blanket to the cylinder.

BRIEF DESCRIPTION OF THE DRAWINGS

The invention is illustrated, by way of example only, in the accompanying drawings, FIGS. 1 and 2.

DETAILED DISCUSSION OF PREFERRED EMBODIMENTS

Figure 1:
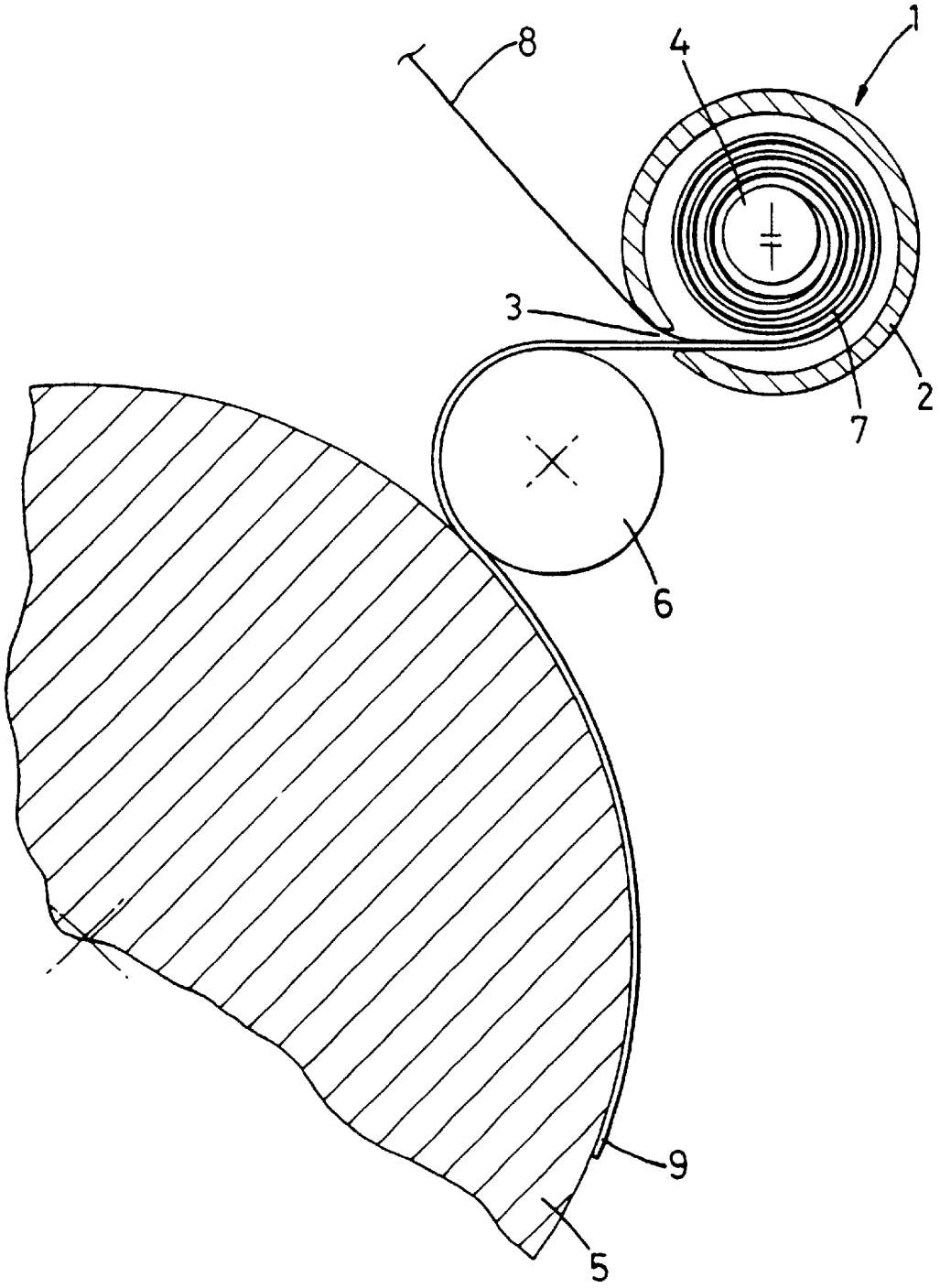

FIG. 1 shows a cassette 1 in accordance with the invention, comprising a cylindrical casing 2 having a longitudinal opening 3 and (optionally) a spindle 4. The cassette is shown in mounted relationship with a printing press cylinder 5 and a pressure roller 6. An adhesive-backed printing blanket 7 with a releasable protective cover sheet 8 on the adhesive backing is in wound-roll form inside the cassette. The leading end portion 9 of the blanket 7 is shown as having been fed Out of the cassette through the opening 3, around the pressure roller 6 and onto the cylinder 5. The protective cover sheet 8 is released from the blanket continuously as the blanket emerges from the cassette, and the pressure roller promotes firm even adhesion of the blanket to the press cylinder surface as the cylinder is rotated about its central axis.

Figure 2:
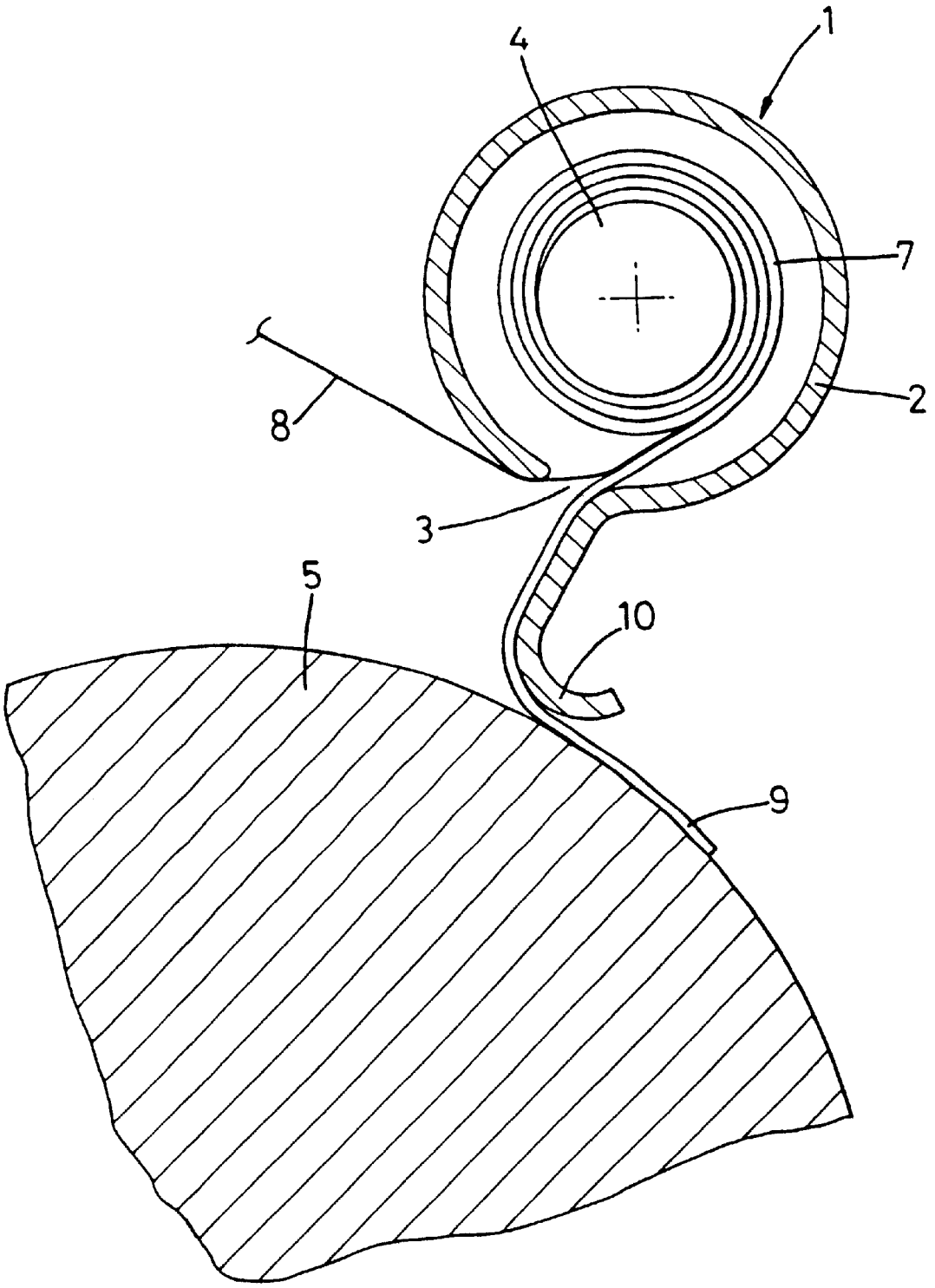

FIG. 2 shows an alternative embodiment of the invention, in which like numerals denote features similar to those of FIG. 1, except that instead of the pressure roller 6 of FIG. 1 there is a pressure slide 10 which is integral with the cassette casing 2.

What is claimed is:

1. A cassette for housing and applying an adhesively backed printing blanket to a printing press cylinder to which said blanket is to be adhesively bonded, said cassette comprising:

a cassette casing having internal dimensions sufficient at least to contain said adhesively backed printing blanket in wound form, said cassette casing having a generally cylindrical shape; said casing having a longitudinal opening for sheet form egression of said printing blanket from within the cassette for application to said printing press cylinder.

* * * * *